US011056758B2

(12) United States Patent
Matsushita et al.

(10) Patent No.: US 11,056,758 B2
(45) Date of Patent: Jul. 6, 2021

(54) DIRECTIONAL COUPLER AND RADIO-FREQUENCY MODULE

(71) Applicant: Murata Manufacturing Co., Ltd., Kyoto (JP)

(72) Inventors: Yosuke Matsushita, Kyoto (JP); Atsushi Kuribara, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 16/683,396

(22) Filed: Nov. 14, 2019

(65) Prior Publication Data

US 2020/0083588 A1 Mar. 12, 2020

Related U.S. Application Data

(63) Continuation of application No. PCT/JP2018/019079, filed on May 17, 2018.

(30) Foreign Application Priority Data

May 19, 2017 (JP) ..... JP2017-099859

(51) Int. Cl.
*H01P 5/18* (2006.01)
*H01P 3/08* (2006.01)
*H01P 11/00* (2006.01)

(52) U.S. Cl.
CPC ..... *H01P 5/184* (2013.01); *H01P 11/003* (2013.01)

(58) Field of Classification Search
CPC ..... H01P 5/18; H01P 3/08
(Continued)

(56) References Cited

U.S. PATENT DOCUMENTS 4,607,240 A * 8/1986 Isota ..... H01P 5/185 333/116
4,967,171 A * 10/1990 Ban ..... H01P 1/203 333/116

(Continued)

FOREIGN PATENT DOCUMENTS

JP H05-83015 A 4/1993
JP H07-131211 A 5/1995

(Continued)

OTHER PUBLICATIONS

Cohn Seymour B., Characteristic Impedances of Broadside-Coupled Strip Transmission Lines, Nov. 1960, IRE vol. 8, Issue 6, 5 pages.*

(Continued)

*Primary Examiner* — Dean O Takaoka
(74) *Attorney, Agent, or Firm* — Pearne & Gordon LLP

(57) ABSTRACT

A directional coupler includes an element body that is insulating, and a main line and a secondary line both disposed in the element body and being conductive. The directional coupler has a mount surface positioned on a mounted side when the directional coupler is mounted. A first line portion of the main line and a second line portion of the secondary line are electromagnetically coupled to each other. The first line portion has a thickness smaller than a line width of the first line portion, and is disposed in the element body in such a manner that an axis along a thickness direction of the first line portion does not intersect the mount surface.

15 Claims, 11 Drawing Sheets

(58) Field of Classification Search
USPC ..... 333/109–112, 116
See application file for complete search history.

(56) References Cited

U.S. PATENT DOCUMENTS

| | | | | |
|---|---|---|---|---|
| 5,032,803 | A * | 7/1991 | Koch | H05K 1/141 333/116 |
| 5,486,798 | A * | 1/1996 | Veitschegger | H01P 5/185 333/116 |
| 5,557,245 | A | 9/1996 | Taketa et al. | |
| 7,034,633 | B2 * | 4/2006 | Passiopoulos | H01L 23/642 333/112 |
| 7,151,421 | B2 * | 12/2006 | Shinabe | H01P 5/185 333/116 |
| 2013/0120076 | A1 | 5/2013 | Mori | |
| 2017/0077578 | A1 | 3/2017 | Baba et al. | |

FOREIGN PATENT DOCUMENTS

| | | | |
|---|---|---|---|
| JP | H08-78915 | A | 3/1996 |
| JP | 3765261 | B2 | 4/2006 |
| JP | 2010-147791 | A | 7/2010 |
| WO | 2012/005041 | A1 | 1/2012 |
| WO | 2015/186538 | A1 | 12/2015 |

OTHER PUBLICATIONS

International Search Report for International Application No. PCT/JP2018/019079, dated Jul. 10, 2018.
Written Opinion for International Application No. PCT/JP2018/019079, dated Jul. 10, 2018.

* cited by examiner

DIRECTIONAL COUPLER AND RADIO-FREQUENCY MODULE

This is a continuation of International Application No. PCT/JP2018/019079 filed on May 17, 2018 which claims priority from Japanese Patent Application No. 2017-099859 filed on May 19, 2017. The contents of these applications are incorporated herein by reference in their entireties.

BACKGROUND

Technical Field

The present disclosure relates to a directional coupler including a main line and a secondary line, and also relates to a radio-frequency module including the directional coupler.

Conventionally, directional couplers including a main line and a secondary line have been known. Directional couplers are used, for example, to electromagnetically couple the secondary line to the main line to allow an electric signal transmitted through the main line to be detected in the secondary line. In a directional coupler disclosed in Patent Document 1, the line surfaces of a main line and a secondary line, which are in a coupling region of the main line and the secondary line, are parallel to a bottom (mount surface) of the directional coupler.

Patent Document 1: Japanese Patent No. 3765261

BRIEF SUMMARY

In the directional coupler disclosed in Patent Document 1, when for example the directional coupler is mounted on a mount substrate, the line surfaces of the main line and the secondary line face a land electrode, a signal electrode, or a ground electrode formed in or on the mount substrate and this causes stray capacitance to occur. The occurrence of stray capacitance degrades the characteristics of the directional coupler.

Accordingly, the present disclosure provides, for example, a directional coupler that can suppress the occurrence of stray capacitance when the directional coupler is mounted on a mount substrate.

A directional coupler according to an aspect of the present disclosure includes an element body that is insulating, and a main line and a secondary line both disposed in the element body and being conductive. The directional coupler has a mount surface positioned on a mounted side when the directional coupler is mounted. A first line portion of the main line and a second line portion of the secondary line are electromagnetically coupled to each other. The first line portion has a thickness smaller than a line width of the first line portion, and is disposed in the element body in such a manner that an axis along a thickness direction of the first line portion does not intersect the mount surface.

As described above, the thickness of the first line portion is made smaller than the line width, and the first line portion is disposed in the element body in such a manner that the axis along the thickness direction of the first line portion does not intersect the mount surface. Thus, when the directional coupler is mounted on a mount substrate, the area where the first line portion faces an electrode of the mount substrate can be reduced. This can suppress the occurrence of stray capacitance when the directional coupler is mounted on the mount substrate, and thus can prevent degradation of characteristics of the directional coupler.

The second line portion may have a thickness smaller than a line width of the second line portion, and may be disposed in the element body in such a manner that an axis along a thickness direction of the second line portion does not intersect the mount surface.

With this configuration, where the thickness of the second line portion is made smaller than the line width and the second line portion is disposed in the element body in such a manner that the axis along the thickness direction of the second line portion does not intersect the mount surface, when the directional coupler is mounted on the mount substrate, the area where the second line portion faces the electrode of the mount substrate can be reduced. This can suppress the occurrence of stray capacitance when the directional coupler is mounted on the mount substrate, and thus can prevent degradation of characteristics of the directional coupler.

The axis along the thickness direction of the first line portion and the axis along the thickness direction of the second line portion may be parallel to the mount surface.

With this configuration, where the axes along the thickness directions of the first line portion and the second line portion are made parallel to the mount surface, when the directional coupler is mounted on the mount substrate, the area where the first line portion and the second line portion face the electrode of the mount substrate can be reduced. This can suppress the occurrence of stray capacitance when the directional coupler is mounted on the mount substrate, and thus can prevent degradation of characteristics of the directional coupler.

The element body may include a plurality of insulating layers stacked along the thickness direction of the first line portion, and the first line portion and the second line portion may each be disposed on one of the plurality of insulating layers.

This makes it easy to form the structure of the directional coupler in which the first line portion and the second line portion are smaller in size in the thickness direction, and also to form the structure of the directional coupler in which the axis along the thickness direction does not intersect the mount surface.

The first line portion and the second line portion may be arranged adjacent to each other in the thickness direction, with at least one of the plurality of insulating layers interposed therebetween.

With this configuration, the lines can face each other by using parts of the first line portion and the second line portion corresponding to the line widths larger in size than the thicknesses of the first line portion and the second line portion. This makes it possible to secure capacitive coupling between the first line portion and the second line portion.

The first line portion and the second line portion may be disposed on the same surface of one of the plurality of insulating layers.

With this configuration, the lines can face each other by using parts of the first line portion and the second line portion corresponding to the thicknesses smaller in size than the line widths of the first line portion and the second line portion. This makes it possible to reduce capacitive coupling between the first line portion and the second line portion.

The first line portion may have a surface perpendicular to the thickness direction of the first line portion, and may be disposed in the element body in such a manner that the surface of the first line portion is perpendicular to the mount surface. The second line portion may have a surface perpendicular to the thickness direction of the second line portion, and may be disposed in the element body in such a manner that the surface of the second line portion is perpendicular to the mount surface.

With this configuration, where the surfaces larger in size than the thicknesses of the first line portion and the second line portion are disposed in a direction perpendicular to the mount surface, when the directional coupler is mounted on the mount substrate, the area where the surfaces face the electrode of the mount substrate can be minimized. This can suppress the occurrence of stray capacitance when the directional coupler is mounted on the mount substrate, and thus can prevent degradation of characteristics of the directional coupler.

The mount surface may have a pair of first mounting terminals connected to respective ends of the main line, and a pair of second mounting terminals connected to respective ends of the secondary line.

This enables accurate mounting of the directional coupler on the mount substrate, and can reduce variation in stray capacitance occurring when the directional coupler is mounted on the mount substrate.

The pair of first mounting terminals and the pair of second mounting terminals may be disposed on the mount surface and embedded from the mount surface into the element body.

This can enhance close contact between the element body and the first and second mounting terminals.

The directional coupler may further include a ground electrode disposed in the element body or on a surface of the element body, and the ground electrode may be disposed on the insulating layer different from the insulating layer having the first line portion or second line portion disposed thereon.

This improves shielding performance of the directional coupler, and enables adjustment of the impedance of the directional coupler to the required specification.

The ground electrode may be disposed outside a region between the first line portion and the second line portion in the thickness directions of the first line portion and the second line portion, and may be disposed in such a manner that an electrode surface of the ground electrode intersects the axes along the thickness directions of the first line portion and the second line portion.

This can prevent a magnetic field generated by the directional coupler from leaking out.

The ground electrode may be disposed in such a manner that the electrode surface is perpendicular to the mount surface.

This can suppress the occurrence of stray capacitance between the ground electrode of the directional coupler and the electrode of the mount substrate.

A radio-frequency module according to another aspect of the present disclosure is a radio-frequency module that includes the directional coupler described above, and a mount substrate having the directional coupler mounted thereon. The mount substrate includes a substrate electrode disposed parallel to a principal surface of the mount substrate, and the directional coupler is mounted on the mount substrate in such a manner that the mount surface is parallel to the substrate electrode.

This radio-frequency module can suppress stray capacitance occurring between the directional coupler and the mount substrate.

The directional coupler according to the present disclosure can suppress the occurrence of stray capacitance when the directional coupler is mounted on the mount substrate. The radio-frequency module according to the present disclosure can suppress stray capacitance occurring between the directional coupler and the mount substrate.

DETAILED DESCRIPTION

Figure 1:
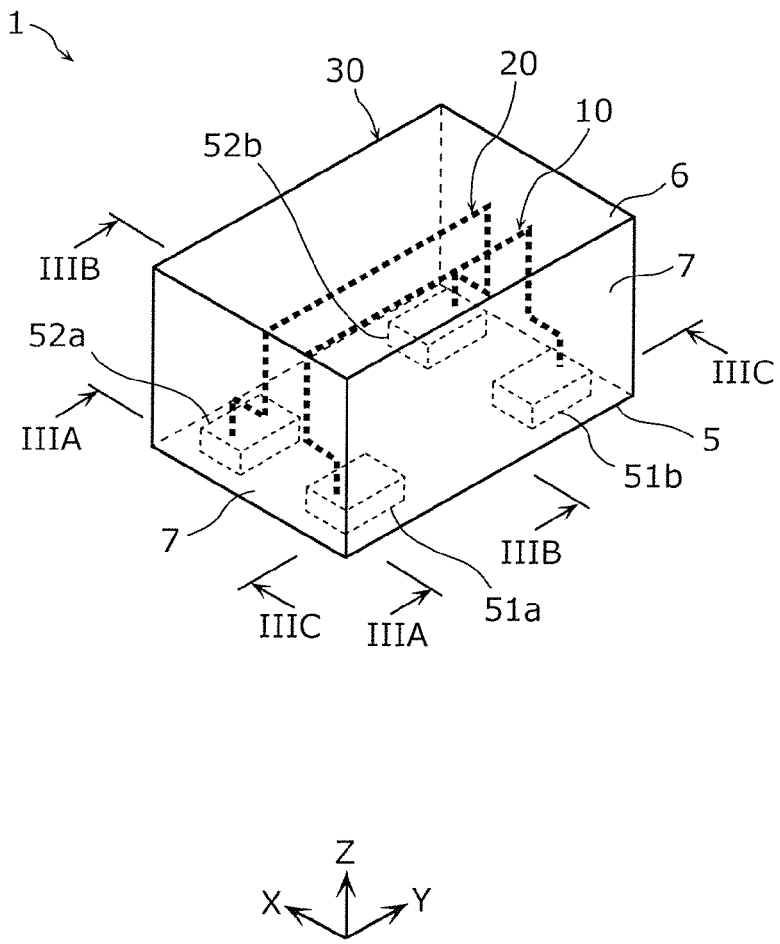
FIG. 1 is a perspective view of a directional coupler according to a first embodiment.

Embodiments of the present disclosure will now be described in detail using the drawings. The embodiments described herein represent either general or specific examples. Numerical values, shapes, materials, component elements, arrangements and modes of connection of the component elements, manufacturing steps, the order of the manufacturing steps, and other features presented in the embodiments are merely examples and are not intended to limit the scope of the present disclosure. Of the component elements in the following embodiments, those not defined in the independent claims will be described as being optional.

Note that the drawings are schematic and are not necessarily exactly to scale. In the drawings, substantially the same components are denoted by the same reference numerals and redundant description will be omitted or simplified.

First Embodiment

[1-1. Configuration of Directional Coupler]

Figure 2:
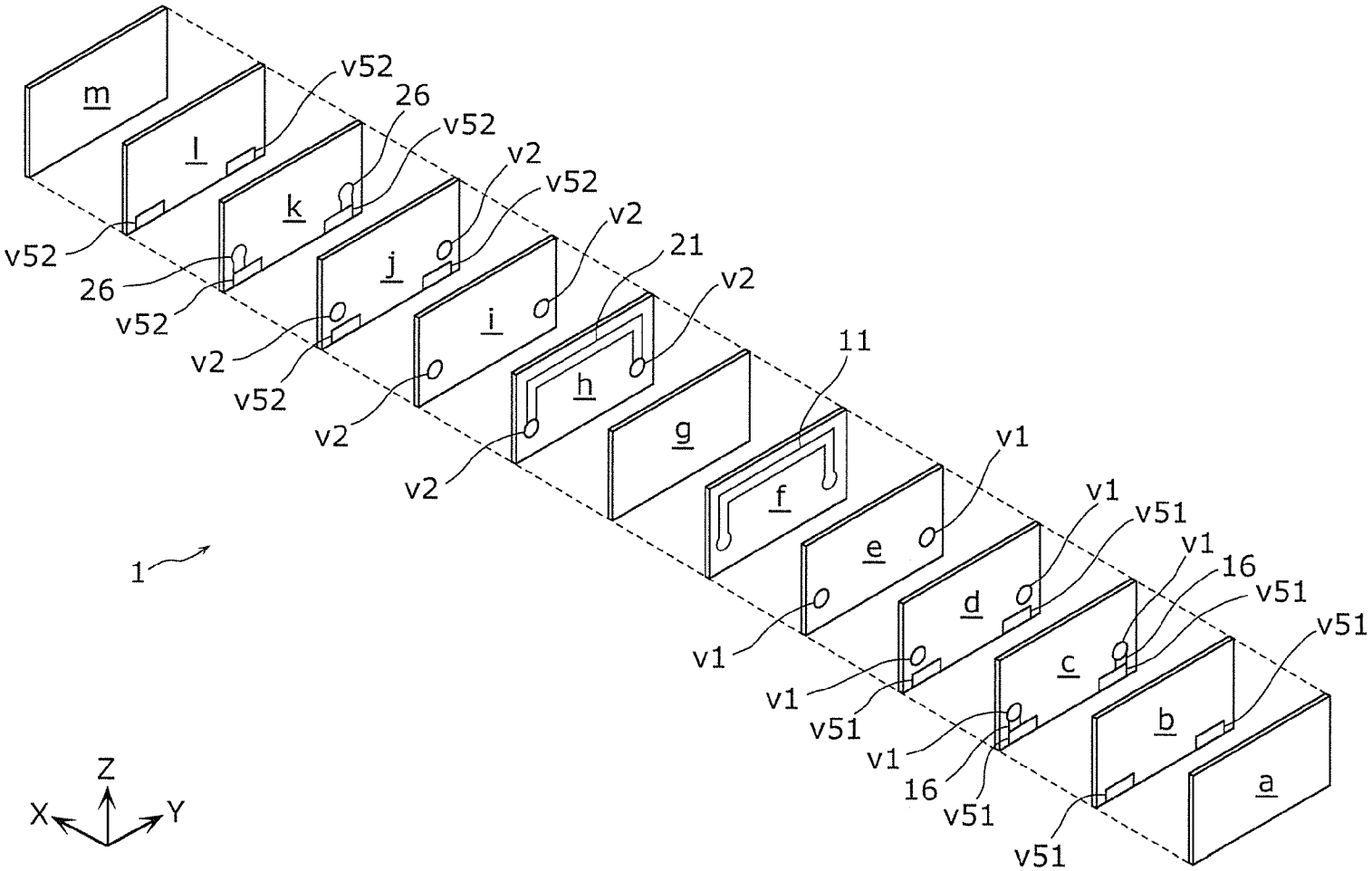
FIG. 2 is an exploded perspective view of the directional coupler according to the first embodiment.
Figure 3A:
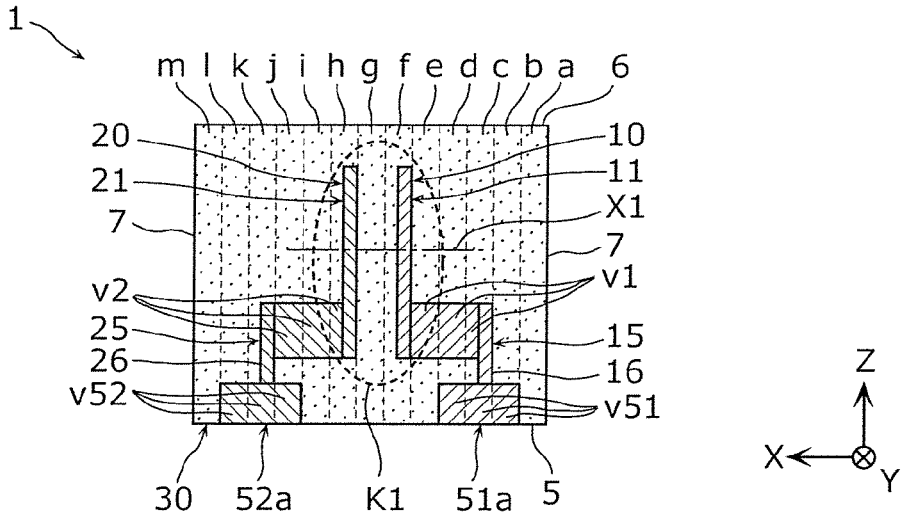
FIG. 3A is a cross-sectional view of the directional coupler according to the first embodiment, taken along line IIIA-IIIA of FIG. 1.
Figure 3B:
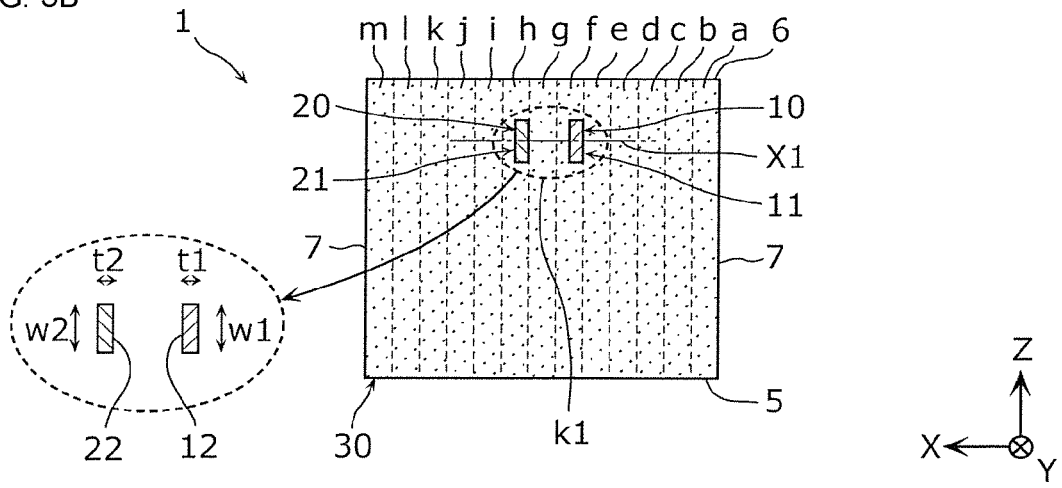
FIG. 3B is a cross-sectional view of the directional coupler according to the first embodiment, taken along line IIIB-IIIB of FIG. 1.
Figure 3C:
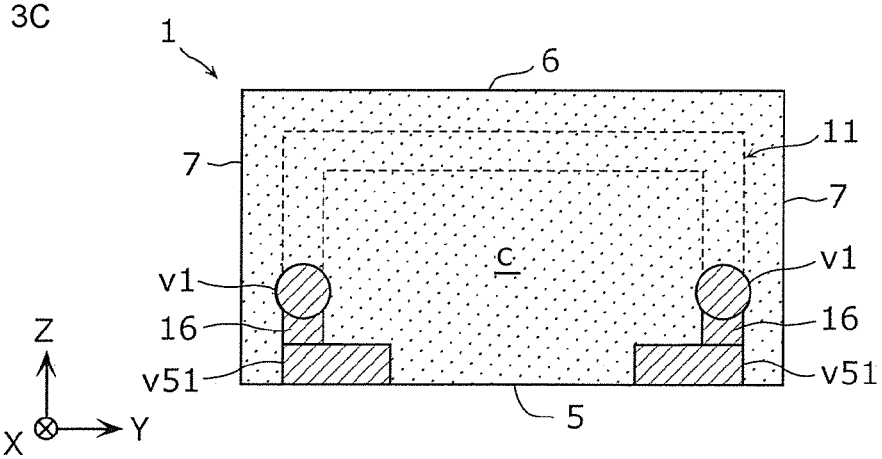
FIG. 3C is a cross-sectional view of the directional coupler according to the first embodiment, taken along line IIIC-IIIC of FIG. 1.

A configuration of a directional coupler 1 according to the present embodiment will be described with reference to FIG. 1 to FIG. 3C. FIG. 1 is a perspective view of the directional coupler 1 according to the present embodiment. FIG. 2 is an exploded perspective view of the directional coupler 1. FIG. 3A is a cross-sectional view of the directional coupler 1 taken along line IIIA-IIIA of FIG. 1. FIG. 3B is a cross-sectional view of the directional coupler 1 taken along line IIIB-IIIB of FIG. 1. FIG. 3C is a cross-sectional view of the directional coupler 1 taken along line IIIC-IIIC of FIG. 1.

As illustrated in FIG. 1 to FIG. 3C, the directional coupler 1 includes an element body 30 that is insulating, and a main line 10 and a secondary line 20 both disposed in the element body 30 and being conductive. The directional coupler 1 also includes a pair of first mounting terminals 51*a* and 51*b* being conductive and a pair of second mounting terminals 52*a* and 52*b* being conductive.

The directional coupler 1 is rectangular parallelepiped-like in outer shape and has a mount surface 5, a top surface 6 opposite the mount surface 5, and four side faces 7 perpendicular to both the mount surface 5 and the top surface 6. The mount surface 5 is a surface positioned on the mounted side when the directional coupler 1 is mounted on a mount substrate. In other words, when the directional coupler 1 is mounted, the mount surface 5 faces a principal surface of the mount substrate.

The element body 30 is formed, for example, by stacking a plurality of insulating layers a, b, c, d, e, f, g, h, i, j, k, l, and m. The plurality of insulating layers a to m are each formed, for example, using a dielectric material. The insulating layers a and m are outermost layers, each serving as an outer coating.

The stacking direction in which the plurality of insulating layers a to m are stacked is defined as the X-direction, the direction in which the mount surface 5 and the top surface 6 face each other is defined as the Z-direction, and the direction perpendicular to both the X-direction and the Z-direction is defined as the Y-direction. The mount surface 5 described above is perpendicular to an axis along the Z-direction, and is parallel to an axis along the X-direction.

The mount surface 5 has the pair of first mounting terminals 51*a* and 51*b* and the pair of second mounting terminals 52*a* and 52*b*. The first mounting terminals 51*a* and 51*b* and the second mounting terminals 52*a* and 52*b* are embedded from the mount surface 5 into the element body 30 in the direction perpendicular to the mount surface 5 (Z-direction).

The first mounting terminals 51*a* and 51*b* and the second mounting terminals 52*a* and 52*b* are arranged in a land grid array (LGA) on the mount surface 5. The first mounting terminals 51*a* and 51*b* and the second mounting terminals 52*a* and 52*b* are each rectangular parallelepiped-like in outer shape. In other words, the first mounting terminals 51*a* and 51*b* and the second mounting terminals 52*a* and 52*b* are each rectangular in cross-section taken along a plane perpendicular to the mount surface 5.

The first mounting terminals 51*a* and 51*b* are each formed by stacking interlayer conductors v51 in the three adjacent insulating layers b, c, and d of the plurality of insulating layers a to m in the stacking direction (see FIG. 2). The second mounting terminals 52*a* and 52*b* are each formed by stacking interlayer conductors v52 in the three adjacent insulating layers j, k, and l in the stacking direction.

The first mounting terminals 51*a* and 51*b* are connected to respective ends of the main line 10. The second mounting terminals 52*a* and 52*b* are connected to respective ends of the secondary line 20.

The main line 10 has a first line portion 11 and a pair of extended line portions 15 connected to respective ends of the first line portion 11 (see FIG. 3A). The extended line portions 15 are each formed by stacking an extended pattern 16 on the insulating layer c (see FIG. 3C) and interlayer conductors v1 in the respective insulating layers c, d, and e in the stacking direction (see FIG. 2). The extended line portions 15 are each connected at one end thereof to the first line portion 11 and connected at the other end thereof to the first mounting terminal 51*a* or 51*b*. The first line portion 11 is an inverted U-shaped conductor pattern formed on the insulating layer f.

An electric signal is transmitted to the first line portion 11 through the first mounting terminals 51*a* and 51*b* and the pair of extended line portions 15. A line thickness t1 of the first line portion 11 is smaller in size than a line width w1 of the first line portion 11 (see FIG. 3B). The first line portion 11 is disposed in such a manner that an axis X1 along the line thickness direction (a direction parallel to the mount surface 5) does not intersect the mount surface 5. Specifically, the axis X1 along the line thickness direction of the first line portion 11 is parallel to the mount surface 5. That is, the first line portion 11 is disposed perpendicular to the mount surface 5. The line thickness direction of the first line portion 11 is the same as the stacking direction of the plurality of insulating layers a to m (X-direction). The first line portion 11 has a line surface 12 perpendicular to the line thickness direction. The line surface 12 of the first line portion 11 is perpendicular to the mount surface 5.

The secondary line 20 has a second line portion 21 and a pair of extended line portions 25 connected to respective ends of the second line portion 21 (see FIG. 3A). The extended line portions 25 are each formed by stacking interlayer conductors v2 in the respective insulating layers h, i, and j and an extended pattern 26 on the insulating layer k in the stacking direction (see FIG. 2). The extended line portions 25 are each connected at one end thereof to the second line portion 21 and connected at the other end thereof to the second mounting terminal 52*a* or 52*b*. The second line portion 21 is formed on the insulating layer h. The shape of the conductor pattern of the second line portion 21 is the same as the shape of the conductor pattern of the first line portion 11.

A line thickness t2 of the second line portion 21 is smaller in size than a line width w2 of the second line portion 21 (see FIG. 3B). The second line portion 21 is disposed in such a manner that the axis X1 along the line thickness direction does not intersect the mount surface 5. Specifically, the axis X1 along the line thickness direction of the second line portion 21 is parallel to the mount surface 5. That is, the second line portion 21 is disposed perpendicular to the mount surface 5. The line thickness direction of the second line portion 21 is the same as the stacking direction of the plurality of insulating layers a to m (X-direction).

The second line portion 21 and the first line portion 11 are arranged adjacent to each other, with the insulating layer g interposed therebetween, in the stacking direction of the insulating layers a to m (i.e., in the line thickness direction of the first line portion 11). The second line portion 21 has a line surface 22 perpendicular to the line thickness direction. The line surface 22 of the second line portion 21 is perpendicular to the mount surface 5 and faces the line surface 12 of the first line portion 11.

The second line portion 21 having the structure described above is electromagnetically coupled to the first line portion 11. Being "electromagnetically coupled" means being "capacitively coupled" and "magnetically coupled" at the same time. That is, the first line portion 11 and the second line portion 21 are capacitively coupled by capacitance formed therebetween, and are magnetically coupled by mutual inductance therebetween. FIG. 3A and FIG. 3B illustrate a coupling region K1 (encircled with a broken line) where the first line portion 11 and the second line portion 21 are electromagnetically coupled. In the directional coupler 1, the electromagnetic coupling of the first line portion 11 and the second line portion 21 enables a signal corresponding to the electric signal transmitted to the first line portion 11, to be transmitted to the second line portion 21.

[1-2. Configuration of Radio-Frequency Module Including Directional Coupler]

Figure 4:
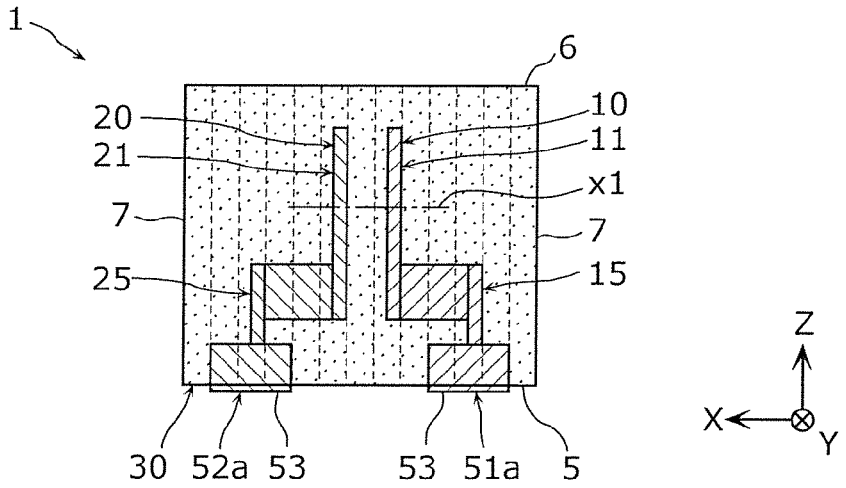
FIG. 4 is a cross-sectional view of the directional coupler according to the first embodiment, illustrating mounting terminals, each having a plating layer thereon.
Figure 5:
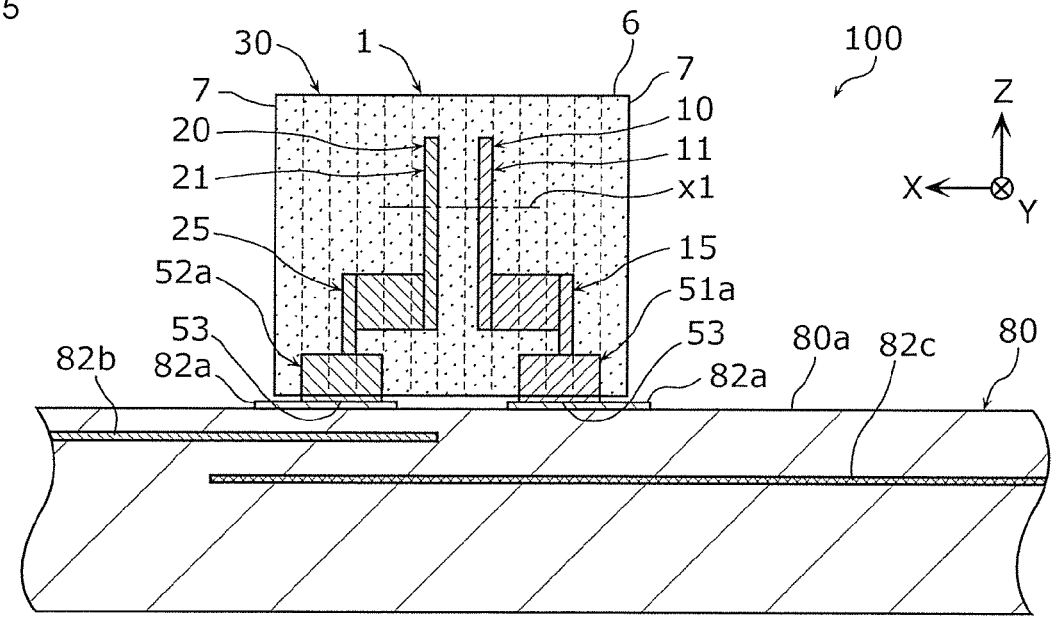
FIG. 5 is a cross-sectional view of a radio-frequency module with the directional coupler of the first embodiment mounted therein.

Next, with reference to FIG. 4 and FIG. 5, a configuration of a radio-frequency module 100 including the directional coupler 1 and advantageous effects of the directional coupler 1 will be described. FIG. 4 is a cross-sectional view of the directional coupler 1 according to the present embodiment, illustrating the mounting terminals, each having a plating layer 53 thereon. FIG. 5 is a cross-sectional view of the radio-frequency module 100 with the directional coupler 1 mounted therein.

As illustrated in FIG. 4, the first mounting terminals 51*a* and 51*b* and the second mounting terminals 52*a* and 52*b* of the directional coupler 1, each have the plating layer 53. The plating layer 53 is formed, for example, using such materials as Ni and Sn.

As illustrated in FIG. 5, the radio-frequency module 100 includes the directional coupler 1 and a mount substrate 80 having the directional coupler 1 mounted thereon.

The mount substrate 80 has, for example, substrate electrodes 82*a*, 82*b*, and 82*c* disposed parallel to a principal surface 80*a* of the mount substrate 80. The substrate electrodes 82*a* are land electrodes formed on the principal surface 80*a* of the mount substrate 80. The substrate electrode 82*b* is a signal-transmitting electrode formed inside the mount substrate 80, and the substrate electrode 82*c* is a ground electrode disposed inside the mount substrate 80.

The directional coupler 1 is mounted, for example, by soldering onto the mount substrate 80 in such a manner that the mount surface 5 of the directional coupler 1 is parallel to the substrate electrode 82*a*, 82*b*, or 82*c*.

In the directional coupler 1 according to the present embodiment, the thickness t1 of the first line portion 11 is smaller than the line width w1, and the thickness t2 of the second line portion 21 is smaller than the line width w2. The first line portion 11 and the second line portion 21 are each disposed in the element body 30 in such a manner that the axis X1 along the line thickness direction does not intersect the mount surface 5. Specifically, the axis X1 is parallel to the mount surface 5. Therefore, when the directional coupler 1 is mounted on the mount substrate 80, the first line portion 11 and the second line portion 21 face the substrate electrode 82*a*, 82*b*, or 82*c* in small parts of the first line portion 11 and the second line portion 21 corresponding to the respective thicknesses t1 and t2. This can reduce the area where the first line portion 11 and the second line portion 21 face the substrate electrode 82*a*, 82*b*, or 82*c*, and can suppress the occurrence of stray capacitance. Thus, the directional coupler 1 according to the present embodiment can suppress the occurrence of stray capacitance when the directional coupler 1 is mounted on the mount substrate 80. It is thus possible to prevent degradation of characteristics of the directional coupler 1.

[1-3. Method for Manufacturing Directional Coupler]

Figure 6:
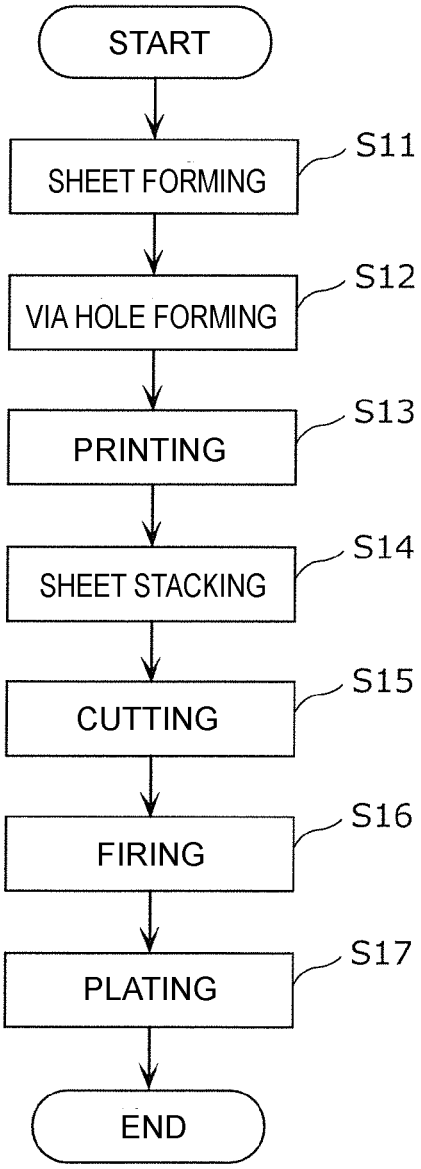
FIG. 6 is a flowchart illustrating a manufacturing method for manufacturing the directional coupler according to the first embodiment.

A method for manufacturing the directional coupler 1 will now be described with reference to FIG. 6 and FIG. 7. FIG. 6 is a flowchart illustrating a manufacturing method for manufacturing the directional coupler 1.

First, a slurry containing ceramic powder, binder, and plasticizer is prepared and applied onto a carrier film to form a sheet (S11: sheet forming step). A plurality of ceramic green sheets serving as bases for forming the insulating layers a to m are thus produced. The ceramic green sheets have a thickness of, for example, 5 μm or more and 100 μm or less. Examples of a device used to apply the slurry include a lip coater and a blade coater.

Next, via holes are formed in the ceramic green sheets (S12: via hole forming step). Through holes for forming the interlayer conductors v1, v2, v51, and v52 in corresponding ones of the ceramic green sheets are thus made. Examples of a device used to form the via holes include a punching machine and a laser beam machine. To form holes for the interlayer conductors v51 and v52 that are rectangular in shape, a rectangular punch or a rectangular mask may be used to form rectangular through holes.

Next, the ceramic green sheets are printed with a conductive paste (S13: printing step). By this printing operation, the via holes are filled with the conductive paste and the interlayer conductors v1, v2, v51, and v52 are formed in corresponding ones of the ceramic green sheets. By this printing operation, conductor patterns, such as the first line portion 11, the second line portion 21, and the extended patterns 16 and 26, are also formed on corresponding ones of the ceramic green sheets. The conductive paste contains such materials as conductive powder (e.g., Cu powder), binder, and plasticizer. Examples of the printing technique used here include screen printing, inkjet printing, gravure printing, and photolithography.

Next, the ceramic green sheets are stacked (S14: sheet stacking step). Specifically, the ceramic green sheets are stacked in the order of the insulating layers a to m illustrated in FIG. 2. Then, the plurality of ceramic green sheets stacked are press-bonded to form a multilayer block B1. The press apparatus used here is, for example, a die press machine.

Next, the multilayer block B1 is cut into individual pieces (S15: cutting step). For example, the following technique is used to cut the multilayer block B1.

Figure 7:
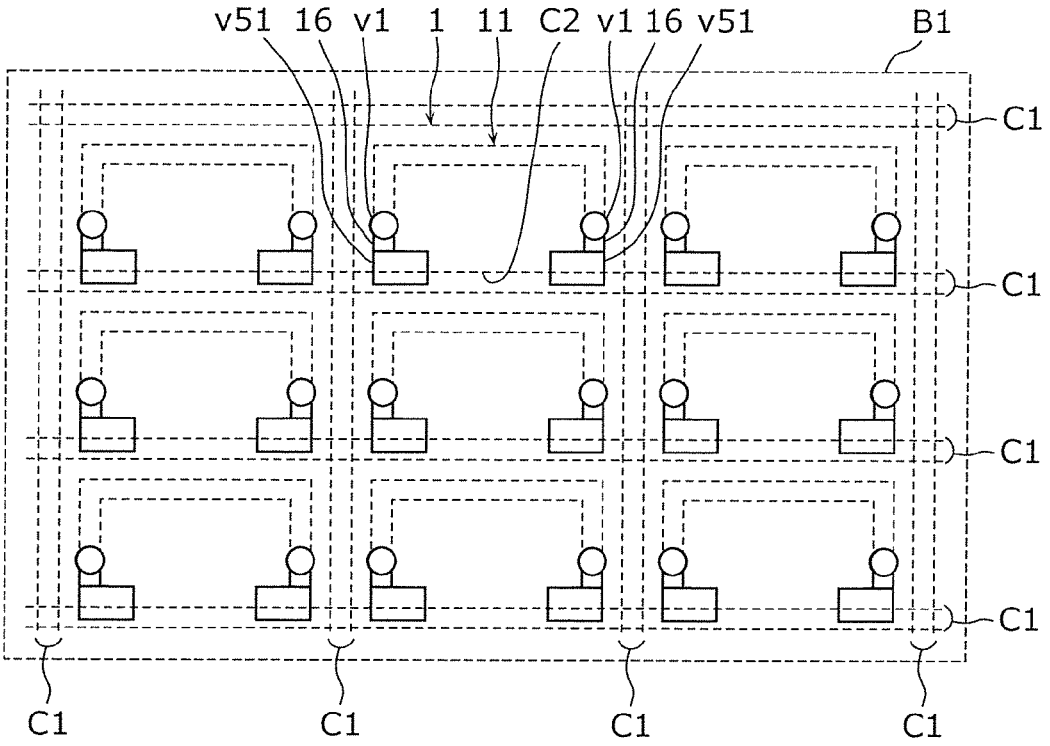
FIG. 7 is a diagram illustrating a cutting step of the manufacturing method for manufacturing the directional coupler according to the first embodiment.

FIG. 7 is a diagram illustrating a cutting step of the manufacturing method for manufacturing the directional coupler 1. FIG. 7 illustrates the multilayer block B1 including a plurality of directional couplers 1 arranged in a matrix. The directional couplers 1 illustrated in FIG. 7 are yet to be sintered or separated into individual pieces. For ease of understanding, FIG. 7 shows only a surface corresponding to the insulating layer c of the multilayer block B1.

For example, when the multilayer block B1 is cut in a grid pattern using a dicing machine, a plurality of cut-and-removed portions C1 are formed in the multilayer block B1.

In the present embodiment, the cut-and-removed portions C1 are provided at positions where the interlayer conductors v51 forming the first mounting terminals 51*a* and 51*b* are partially cut away. Therefore, when the cut-and-removed portions C1 are formed by cutting, the interlayer conductors v51 are exposed on a cut surface C2. Thus, the interlayer conductors v51 forming the first mounting terminals 51*a* and 51*b* are formed in such a manner as to be embedded from the cut surface C2 into the directional couplers 1.

Next, the directional couplers 1 separated but yet to be sintered are fired (S16: firing step). As a firing apparatus, for example, a batch firing furnace or a belt-type firing furnace is used. In this firing operation, the ceramic powder in the ceramic green sheets is sintered and the conductive powder in the conductive paste is also sintered. The sintering of the conductive paste produces the main line 10, the secondary line 20, the first mounting terminals 51*a* and 51*b*, and the second mounting terminals 52*a* and 52*b*. The cut surface C2 formed in the cutting step serves as the mount surface 5 after the firing. The first mounting terminals 51*a* and 51*b* formed by the interlayer conductors v51 are embedded from the mount surface 5 into the element body 30 while being exposed on the mount surface 5.

Next, the plating layer 53 is formed on each of the exposed first mounting terminals 51*a* and 51*b* and second mounting terminals 52*a* and 52*b* (S17: plating step). Electrolytic plating using Ni or Sn is used as a plating technique. When an Au material is used to form the plating layer 53, electroless plating or other techniques may be used. The plating step may be omitted as appropriate. The directional coupler 1 is thus made by steps S11 to S17 described above.

[1-4. Directional Coupler According to First Modification of First Embodiment]

Figure 8:
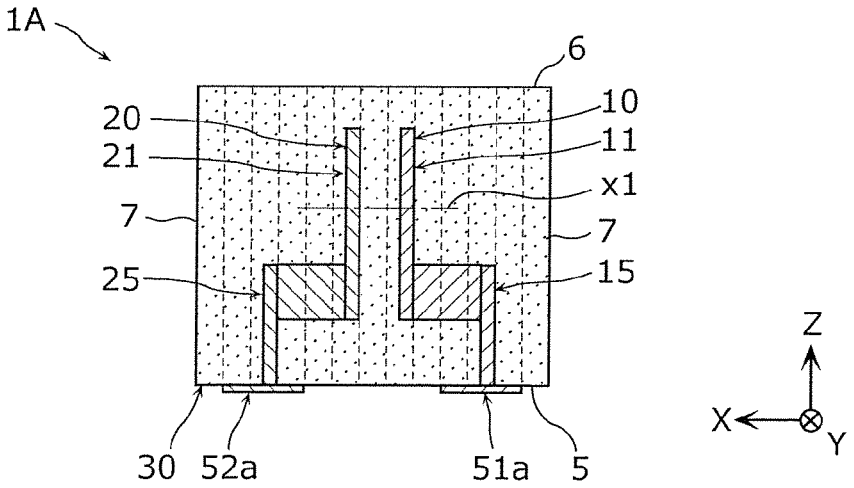
FIG. 8 is a cross-sectional view of a directional coupler according to a first modification of the first embodiment.

FIG. 8 is a cross-sectional view of a directional coupler 1A according to a first modification of the first embodiment. In the directional coupler 1A according to the first modification, the first mounting terminals 51*a* and 51*b* and the second mounting terminals 52*a* and 52*b* are formed on the exterior of the mount surface 5, instead of being embedded in the element body 30.

Specifically, the pair of extended patterns 16 on the insulating layer c is extended toward the mount surface 5 and exposed, at the respective end portions of the extended patterns 16, on the mount surface 5. The end portions exposed on the mount surface 5 are each connected to the first mounting terminal 51*a* or 51*b*. Similarly, the pair of extended patterns 26 on the insulating layer k is extended toward the mount surface 5 and exposed, at the respective end portions of the extended patterns 26, on the mount surface 5. The end portions exposed on the mount surface 5 are each connected to the second mounting terminal 52*a* or 52*b*.

In the directional coupler 1A according to the first modification, again the first line portion 11 and the second line portion 21 are each disposed in the element body 30 in such a manner that the axis X1 along the line thickness direction does not intersect the mount surface 5. Therefore, when the directional coupler 1A is mounted on the mount substrate 80, the first line portion 11 and the second line portion 21 face the substrate electrode 82*a*, 82*b*, or 82*c* in small parts of the first line portion 11 and the second line portion 21 corresponding to the respective thicknesses t1 and t2. This can reduce the area where the first line portion 11 and the second line portion 21 face the substrate electrodes 82*a* to 82*c*, and thus can suppress the occurrence of stray capacitance.

[1-5. Directional Coupler According to Second Modification of First Embodiment]

Figure 9:
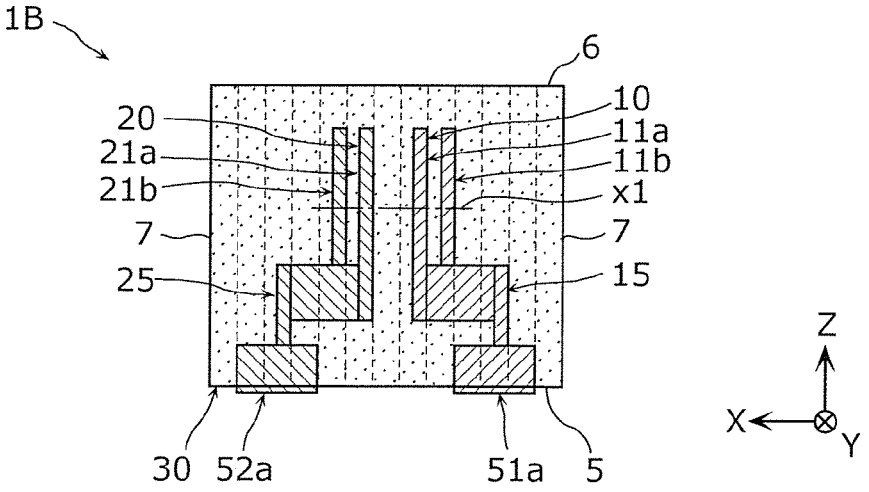
FIG. 9 is a cross-sectional view of a directional coupler according to a second modification of the first embodiment.

FIG. 9 is a cross-sectional view of a directional coupler 1B according to a second modification of the first embodiment. In the directional coupler 1B according to the second modification, the first line portion 11 and the second line portion 21, each have a multilayer structure, instead of a single layer structure.

Specifically, the first line portion 11 is composed of a line portion 11*a* (first layer) formed on the insulating layer f, a line portion 11*b* (second layer) formed on the insulating layer e, and an interlayer conductor (not shown) connecting the line portion 11*a* and the line portion 11*b*. The first line portion 11 has 7/4 turns. Similarly, the second line portion 21 is composed of a line portion 21*a* (first layer) formed on the insulating layer h, a line portion 21*b* (second layer) formed on the insulating layer i, and an interlayer conductor (not shown) connecting the line portion 21*a* and the line portion 21*b*. The second line portion 21 has 7/4 turns. Thus, in the directional coupler 1B, the first line portion 11 and the second line portion 21 have more turns and this increases the degree of coupling between the first line portion 11 and the second line portion 21.

In the directional coupler 1B according to the second modification, again the first line portion 11 and the second line portion 21 are each disposed in the element body 30 in such a manner that the axis X1 along the line thickness direction does not intersect the mount surface 5. Therefore, when the directional coupler 1B is mounted on the mount substrate 80, the first line portion 11 (line portions 11*a* and 11*b*) and the second line portion 21 (line portions 21*a* and 21*b*) face the substrate electrode 82*a*, 82*b*, or 82*c* in small parts of the first line portion 11 and the second line portion 21 corresponding to the respective thicknesses t1 and t2. This can reduce the area where the first line portion 11 and the second line portion 21 face the substrate electrodes 82*a* to 82*c*, and thus can suppress the occurrence of stray capacitance.

Second Embodiment

A configuration of a directional coupler 1C according to a second embodiment will now be described with reference to FIG. 10 to FIG. 12C. The directional coupler 1 according to the first embodiment is a surface-coupled directional coupler where the line surfaces 12 and 22 of the first line portion 11 and the second line portion 21 are coupled to each other. In contrast, the directional coupler 1C according to the second embodiment is a side-edge-coupled directional coupler where edges 13 and 23 of the first line portion 11 and the second line portion 21 are coupled to each other.

Figure 10:
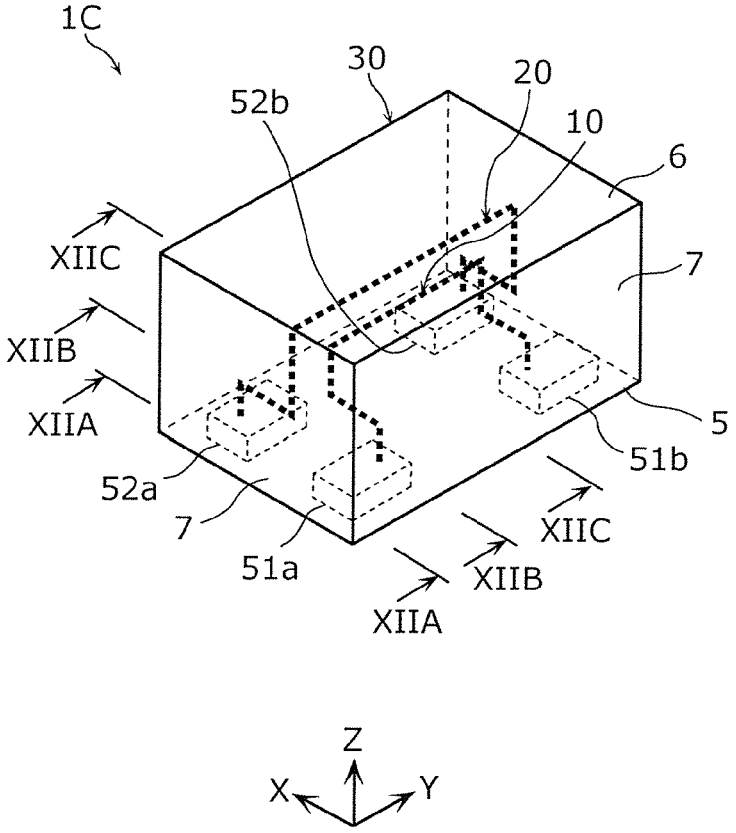
FIG. 10 is a perspective view of a directional coupler according to a second embodiment.
Figure 11:
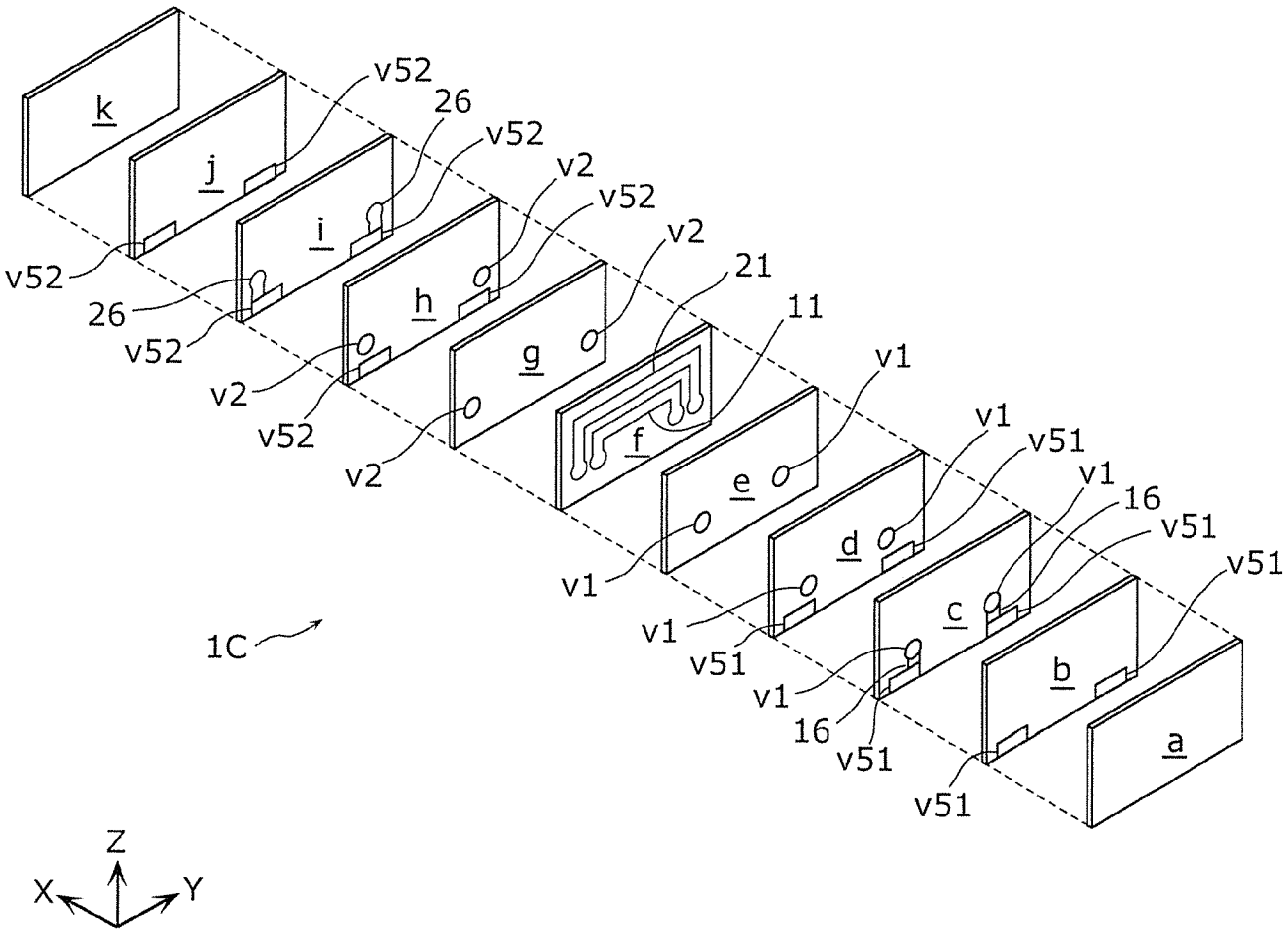
FIG. 11 is an exploded perspective view of the directional coupler according to the second embodiment.
Figure 12A:
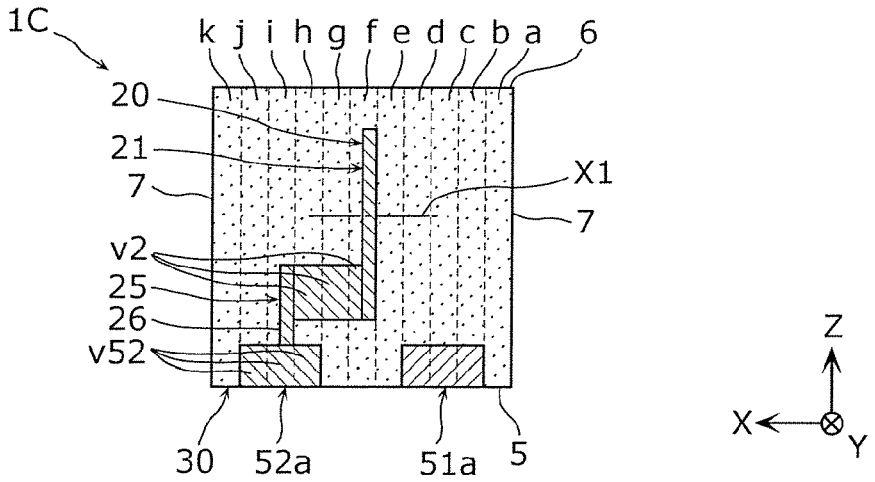
FIG. 12A is a cross-sectional view of the directional coupler according to the second embodiment, taken along line XIIA-XIIA of FIG. 10.
Figure 12B:
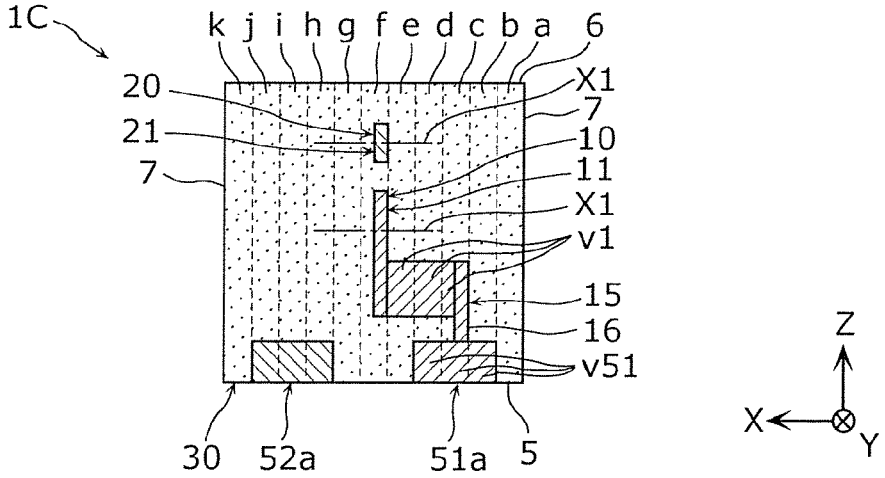
FIG. 12B is a cross-sectional view of the directional coupler according to the second embodiment, taken along line XIIB-XIIB of FIG. 10.
Figure 12C:
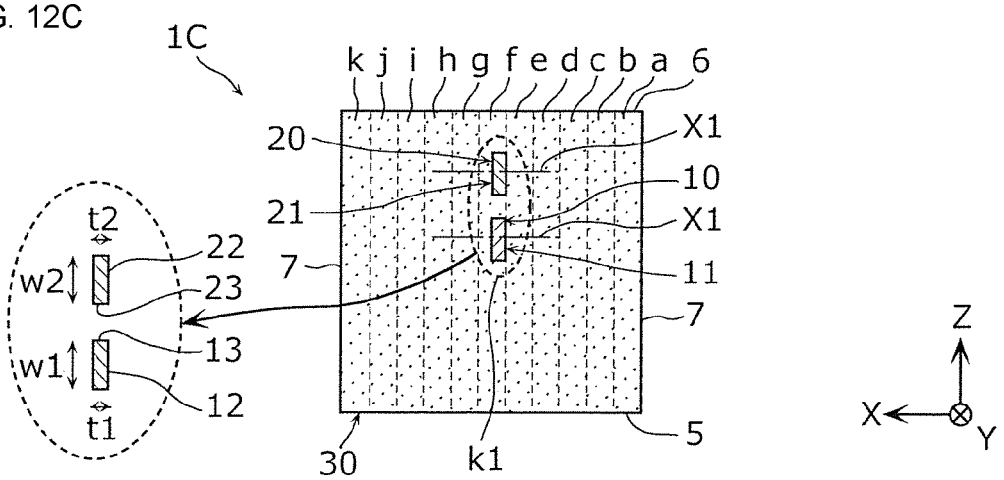
FIG. 12C is a cross-sectional view of the directional coupler according to the second embodiment, taken along line XIIC-XIIC of FIG. 10.

FIG. 10 is a perspective view of the directional coupler 1C according to the second embodiment. FIG. 11 is an exploded perspective view of the directional coupler 1C. FIG. 12A is a cross-sectional view of the directional coupler 1C taken along line XIIA-XIIA of FIG. 10. FIG. 12B is a cross-sectional view of the directional coupler 1C taken along line XIIB-XIIB of FIG. 10. FIG. 12C is a cross-sectional view of the directional coupler 1C taken along line XIIC-XIIC of FIG. 10.

As illustrated in FIG. 10 to FIG. 12C, the directional coupler 1C includes the element body 30 that is insulating, and the main line 10 and the secondary line 20 both disposed in the element body 30 and being conductive. The directional coupler 1C also includes the pair of first mounting terminals 51*a* and 51*b* being conductive and the pair of second mounting terminals 52*a* and 52*b* being conductive.

The directional coupler 1C is rectangular parallelepiped-like in outer shape and has the mount surface 5, the top surface 6 opposite the mount surface 5, and the four side faces 7 perpendicular to both the mount surface 5 and the top surface 6.

The element body 30 is formed, for example, by stacking the plurality of insulating layers a, b, c, d, e, f, g, h, i, j, and k. The insulating layers a and k are outermost layers, each serving as an outer coating.

The first mounting terminals 51*a* and 51*b* are each formed by stacking the interlayer conductors v51 in the three adjacent insulating layers b, c, and d of the plurality of insulating layers a to k in the stacking direction (see FIG. 11). The second mounting terminals 52*a* and 52*b* are each formed by stacking the interlayer conductors v52 in the three adjacent insulating layers h, i, and j in the stacking direction.

The main line 10 has the first line portion 11 and the pair of extended line portions 15 connected to the respective ends of the first line portion 11 (see FIG. 12B). The extended line portions 15 are each formed by stacking the extended pattern 16 on the insulating layer c and the interlayer conductors v1 in the insulating layers c, d, and e in the stacking direction (see FIG. 11). The first line portion 11 is an inverted U-shaped conductor pattern formed on the insulating layer f.

An electric signal is transmitted to the first line portion 11 through the first mounting terminals 51*a* and 51*b* and the extended line portions 15. The line thickness t1 of the first line portion 11 is smaller in size than the line width w1 of the first line portion 11 (see FIG. 12C). The first line portion 11 is disposed in such a manner that the axis X1 along the line thickness direction does not intersect the mount surface 5. Specifically, the axis X1 along the line thickness direction of the first line portion 11 is parallel to the mount surface 5. The line thickness direction of the first line portion 11 is the same as the stacking direction of the plurality of insulating layers a to k. The first line portion 11 has the line surface 12 perpendicular to the line thickness direction. The line surface 12 of the first line portion 11 is perpendicular to the mount surface 5. The first line portion 11 has, at respective ends thereof in the line width direction, the edges 13 perpendicular to the line surface 12.

The secondary line 20 has the second line portion 21 and the pair of extended line portions 25 connected to the respective ends of the second line portion 21 (see FIG. 12A). The extended line portions 25 are each formed by stacking the interlayer conductors v2 in the insulating layers f, g, h, and the extended pattern 26 on the insulating layer i in the stacking direction (see FIG. 11). The second line portion 21 is formed on the insulating layer f. The conductor pattern of the second line portion 21 is larger than the conductor pattern of the first line portion 11, and is formed over a side of the conductor pattern of the first line portion 11 adjacent to the top surface 6.

The line thickness t2 of the second line portion 21 is smaller in size than the line width w2 of the second line portion 21 (see FIG. 12C). The second line portion 21 is disposed in such a manner that the axis X1 along the line thickness direction does not intersect the mount surface 5. Specifically, the axis X1 along the line thickness direction of the second line portion 21 is parallel to the mount surface 5. The line thickness direction of the second line portion 21 is the same as the stacking direction of the plurality of insulating layers a to k.

The second line portion 21 and the first line portion 11 are formed on the same surface of the insulating layer f, and arranged adjacent to each other on this same surface. The second line portion 21 has the line surface 22 perpendicular to the line thickness direction. The line surface 22 of the second line portion 21 is perpendicular to the mount surface 5. The second line portion 21 has, at respective ends thereof in the line width direction, the edges 23 perpendicular to the line surface 22. In the direction perpendicular to the mount surface 5 (Z-direction), one of the edges 23 of the second line portion 21 faces a corresponding one of the edges 13 of the first line portion 11.

The second line portion 21 having the structure described above is electromagnetically coupled to the first line portion 11. FIG. 12C illustrates the coupling region K1 (encircled with a broken line) where the first line portion 11 and the second line portion 21 are electromagnetically coupled. In the directional coupler 1C, the electromagnetic coupling of the first line portion 11 and the second line portion 21 enables a signal corresponding to the electric signal transmitted to the first line portion 11, to be transmitted to the second line portion 21.

In the directional coupler 1C according to the second embodiment, the thickness t1 of the first line portion 11 is smaller than the line width w1, and the thickness t2 of the second line portion 21 is smaller than the line width w2. The first line portion 11 and the second line portion 21 are each disposed in the element body 30 in such a manner that the axis X1 along the line thickness direction does not intersect the mount surface 5. Therefore, when the directional coupler 1C is mounted on the mount substrate 80, the first line portion 11 and the second line portion 21 face the substrate electrode 82*a*, 82*b*, or 82*c* of the mount substrate 80 in small parts of the first line portion 11 and the second line portion 21 corresponding to the respective thicknesses t1 and t2. This can reduce the area where the first line portion 11 and the second line portion 21 face the substrate electrodes 82*a* to 82*c*, and can suppress the occurrence of stray capacitance. Thus, the directional coupler 1C according to the present embodiment can suppress the occurrence of stray capacitance when the directional coupler 1C is mounted on the mount substrate 80. It is thus possible to prevent degradation of characteristics of the directional coupler 1C.

Third Embodiment

[3-1. Configuration of Directional Coupler]

A configuration of a directional coupler 1D according to a third embodiment will now be described with reference to FIG. 13 to FIG. 14C. The directional coupler 1D according to the third embodiment includes a plurality of ground electrodes 41 disposed in the element body 30.

Figure 13:
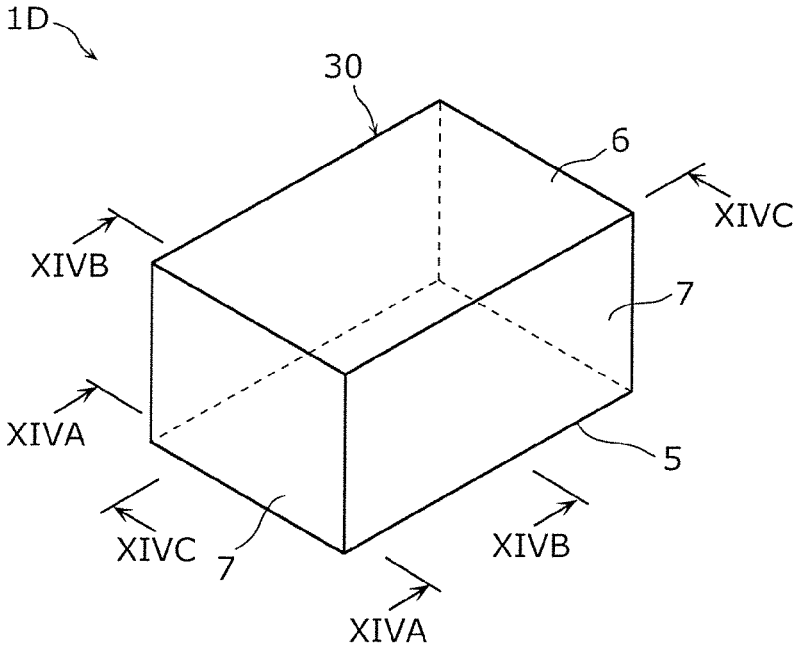
FIG. 13 is a perspective view of a directional coupler according to a third embodiment.
Figure 13:
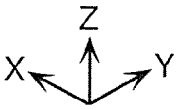
Figure 14A:
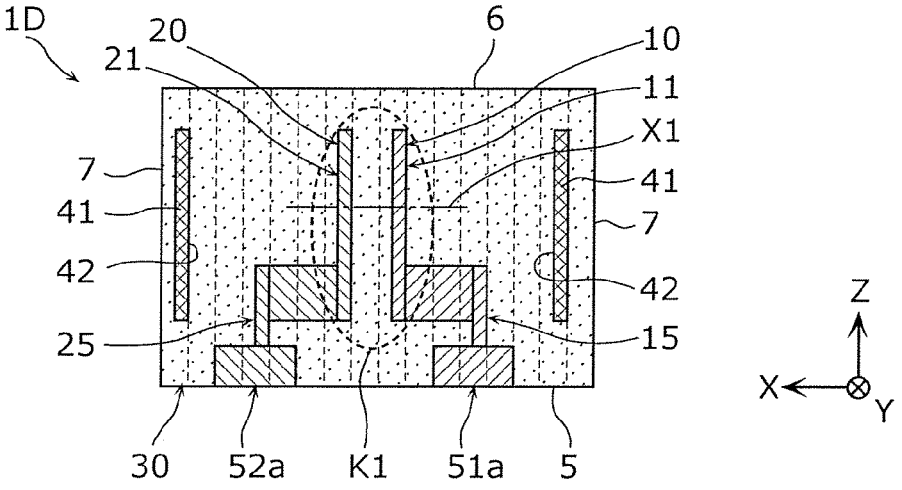
FIG. 14A is a cross-sectional view of the directional coupler according to the third embodiment, taken along line XIVA-XIVA of FIG. 13.
Figure 14B:
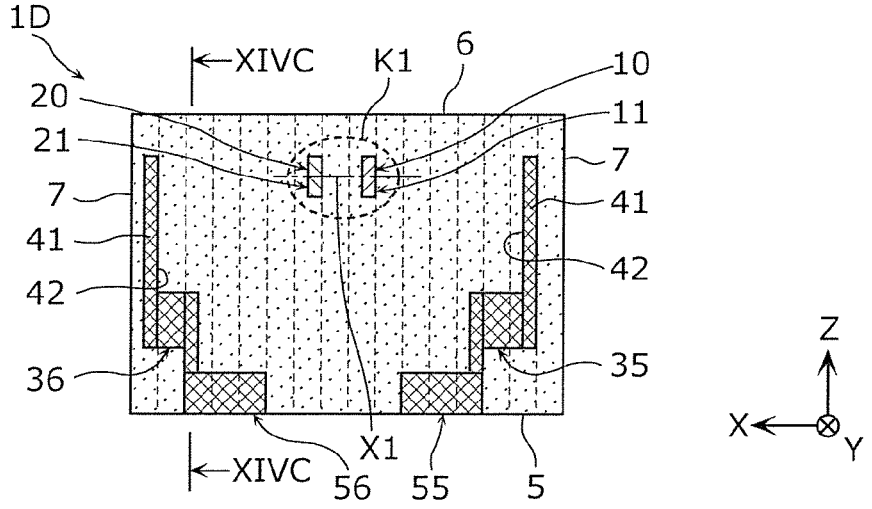
FIG. 14B is a cross-sectional view of the directional coupler according to the third embodiment, taken along line XIVB-XIVB of FIG. 13.
Figure 14C:
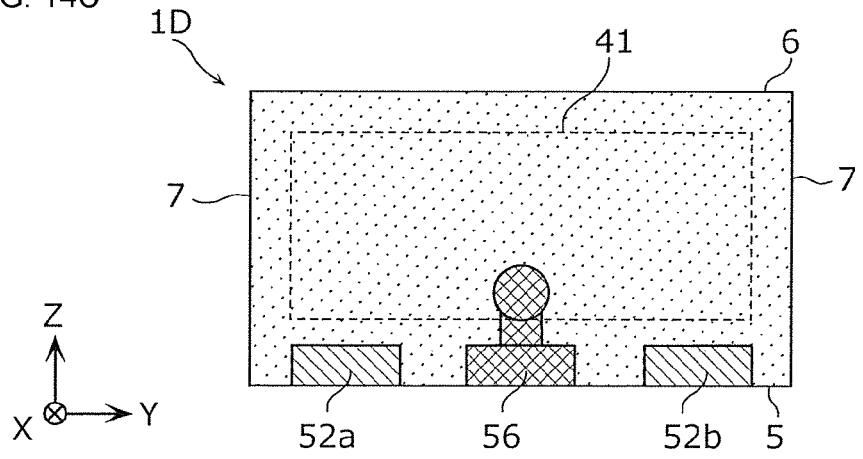
FIG. 14C is a cross-sectional view of the directional coupler according to the third embodiment, taken along line XIVC-XIVC of FIG. 13.

FIG. 13 is a perspective view of the directional coupler 1D according to the third embodiment. FIG. 14A is a cross-sectional view of the directional coupler 1D taken along line XIVA-XIVA of FIG. 13. FIG. 14B is a cross-sectional view of the directional coupler 1D taken along line XIVB-XIVB of FIG. 13. FIG. 14C is a cross-sectional view of the directional coupler 1D taken along line XIVC-XIVC of FIG. 13.

As illustrated in FIG. 14A, the ground electrodes 41 are disposed in insulating layers different from the insulating layers f and h where the first line portion 11 and the second line portion 21 are disposed. In the thickness direction of the first line portion 11 and the second line portion 21, the ground electrodes 41 are disposed outside the region between the first line portion 11 and the second line portion 21 (i.e., outside the region across which the first line portion 11 and the second line portion 21 face each other). The ground electrodes 41 are each disposed in such a manner that an electrode surface 42 of the ground electrode 41 intersects the axis X1 along the thickness direction of the first line portion 11 and the second line portion 21. The electrode surface 42 of each of the ground electrodes 41 is perpendicular to the mount surface 5.

As illustrated in FIG. 14B, one of the two ground electrodes 41 is connected to a mounting ground terminal 55, with an extended portion 35 interposed therebetween. The mounting ground terminal 55 is interposed between the first mounting terminal 51*a* and the first mounting terminal 51*b* on the mount surface 5. As illustrated in FIG. 14B and FIG. 14C, the other ground electrode 41 is connected to a mounting ground terminal 56, with an extended portion 36 interposed therebetween. The mounting ground terminal 56 is interposed between the second mounting terminal 52*a* and the second mounting terminal 52*b* on the mount surface 5.

In the directional coupler 1D of the third embodiment, the ground electrodes 41 improve shielding performance, and can prevent a magnetic field from leaking out or can block external noise from entering. Also, with the ground electrodes 41, it is possible to adjust the impedance of the directional coupler 1D and set the degree of coupling or directivity to the required specification.

In the directional coupler 1D according to the third modification, again the first line portion 11 and the second line portion 21 are each disposed in the element body 30 in such a manner that the axis X1 along the line thickness direction does not intersect the mount surface 5. Therefore, when the directional coupler 1D is mounted on the mount substrate 80, the first line portion 11 and the second line portion 21 face the electrode of the mount substrate 80 in small parts of the first line portion 11 and the second line portion 21 corresponding to the respective thicknesses t1 and t2. This can reduce the area where the first line portion 11 and the second line portion 21 face the electrode of the mount substrate 80, and can suppress the occurrence of stray capacitance. Thus, the directional coupler 1D according to the present embodiment can suppress the occurrence of stray capacitance when the directional coupler 1D is mounted on the mount substrate 80. It is thus possible to prevent degradation of the characteristics of the directional coupler 1D.

In the directional coupler 1D, stray capacitance occurs between each ground electrode 41 and a corresponding one of the first line portion 11 and the second line portion 21. However, this stray capacitance can be determined to a certain extent at the stage of designing the directional coupler 1D, and thus does not have a significant impact on variation in the characteristics of the directional coupler 1D. For example, in a conventional directional coupler, the stray capacitance varies depending on the shape or position of the substrate electrodes 82*a* to 82*c* of the mount substrate 80, and this tends to cause variation in the characteristics of the directional coupler. In the directional coupler 1D according to the third embodiment, however, the stray capacitance occurring in the directional coupler 1D is set to fall within a predetermined range, and the stray capacitance occurring between the directional coupler 1D and the substrate electrodes 82*a* to 82*c* of the mount substrate 80 can be suppressed by the configuration similar to that of the first embodiment. That is, in the directional coupler 1D of the third embodiment, it is possible not only to suppress stray capacitance occurring when the directional coupler 1D is mounted on the mount substrate 80, but also to reduce variation in the characteristics of the directional coupler 1D.

[3-2. Directional Coupler According to Modification of Third Embodiment]

Figure 15:
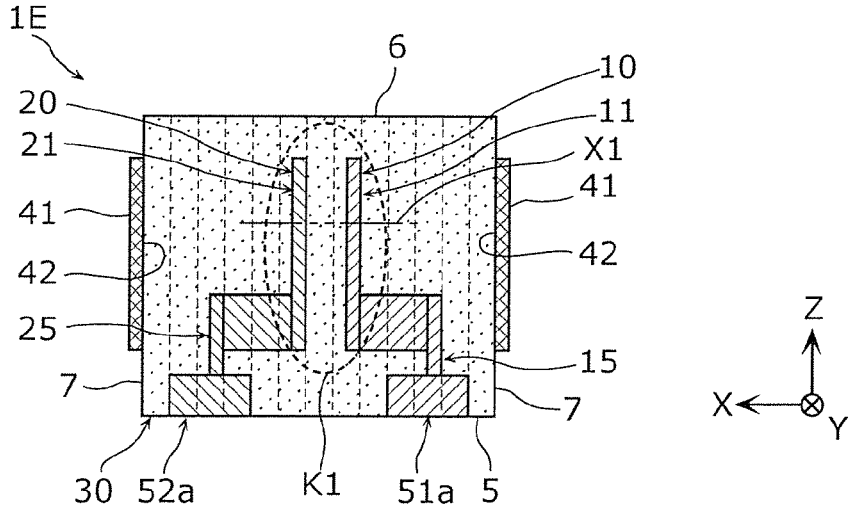
FIG. 15 is a cross-sectional view of a directional coupler according to a modification of the third embodiment.

FIG. 15 is a cross-sectional view of a directional coupler 1E according to a modification of the third embodiment. The directional coupler 1E according to the modification includes two ground electrodes 41 on the surface of the element body 30.

Specifically, in the thickness direction of the first line portion 11 and the second line portion 21, the ground electrodes 41 are disposed outside the region between the first line portion 11 and the second line portion 21 (i.e., outside the region across which the first line portion 11 and the second line portion 21 face each other). The ground electrodes 41 are disposed on the respective side faces 7 of the element body 30 in such a manner that the electrode surfaces 42 intersect the axis X1 along the thickness direction of the first line portion 11 and the second line portion 21.

In the directional coupler 1E according to the first modification, again the first line portion 11 and the second line portion 21 are each disposed in the element body 30 in such a manner that the axis X1 along the line thickness direction does not intersect the mount surface 5. Therefore, when the directional coupler 1E is mounted on the mount substrate 80, the first line portion 11 and the second line portion 21 face the substrate electrode 82*a*, 82*b*, or 82*c* in small parts of the first line portion 11 and the second line portion 21 corresponding to the respective thicknesses t1 and t2. This can reduce the area where the first line portion 11 and the second line portion 21 face the substrate electrodes 82*a* to 82*c*, and thus can suppress the occurrence of stray capacitance.

Other Embodiments

Although the directional couplers and the radio-frequency module according to the first, second, and third embodiments of the present disclosure and their modifications have been described, the present disclosure is not limited to the first, second, and third embodiments and their modifications. Any embodiments obtained by making various changes conceived by those skilled in the art to the first, second, and third embodiments and their modifications, and any embodiments obtained by combining component elements of different embodiments and their modifications, may be included in the scope of one or more embodiments of the present disclosure, as long as they do not depart from the spirit of the present disclosure.

The element body 30 of the directional coupler 1 according to the first embodiment may include one or more insulating layers different from the plurality of insulating layers a to m described above. For example, the first mounting terminals 51*a* and 51*b* may each be formed by stacking the interlayer conductors v51 in four or more adjacent insulating layers, and the second mounting terminals 52*a* and 52*b* may each be formed by stacking the interlayer conductors v52 in four or more adjacent insulating layers. For example, the insulating layer g interposed between the first line portion 11 and the second line portion 21 does not necessarily need to be a single layer, and may be formed by a plurality of insulating layers. For example, the extended line portions 15, each do not necessarily need to be formed by stacking the interlayer conductors v1 in the three insulating layers c, d, and e, and may be formed by stacking the interlayer conductors v1 in four or more adjacent insulating layers. For example, the extended line portions 25, each do not necessarily need to be formed by stacking the interlayer conductors v2 in the three insulating layers h, i, j, and may be formed by stacking the interlayer conductors v2 in four or more adjacent insulating layers.

Although the main line 10 of the directional coupler 1 according to the first embodiment is composed of the first line portion 11 and the extended line portions 15, the main line 10 does not necessarily need to include the extended line portions 15. That is, the first line portion 11 may be extended at both ends thereof toward the mount surface 5 and connected to the first mounting terminals 51*a* and 51*b*. Similarly, although the secondary line 20 of the directional coupler 1 is composed of the second line portion 21 and the extended line portions 25, the secondary line 20 does not necessarily need to include the extended line portions 25. That is, the second line portion 21 may be extended at both ends thereof toward the mount surface 5 and connected to the second mounting terminals 52*a* and 52*b*.

The cross-sectional shape of the first line portion 11 and the second line portion 21 according to the first embodiment does not necessarily need to be rectangular, and may be oval or may have an arc-like curve.

INDUSTRIAL APPLICABILITY

As a directional coupler that suppresses the occurrence of stray capacitance when mounted on a mount substrate, any of the directional couplers according to the present disclosure can be widely used as a component mounted in a radio-frequency module.

REFERENCE SIGNS LIST

1, 1A, 1B, 1C, 1D, 1E: directional coupler
5: mount surface
6: top surface
7: side face
10: main line
11: first line portion
12: line surface (surface)
13: edge
15: extended line portion
16: extended pattern
20: secondary line
21: second line portion
22: line surface (surface)
23: edge
25: extended line portion
26: extended pattern
30: element body
41: ground electrode
42: electrode surface
51*a*, 51*b*: first mounting terminal
52*a*, 52*b*: second mounting terminal
53: plating layer
80: mount substrate
80*a*: principal surface
82*a*, 82*b*, 82*c*: substrate electrode
100: radio-frequency module
a, b, c, d, e, f, g, h, i, j, k, l, m: insulating layer
B1: multilayer block
C1: cut-and-removed portion
C2: cut surface
K1: coupling region
t1, t2: thickness
v1, v2, v51, v52: interlayer conductor
X1: axis along thickness direction
w1, w2: line width

The invention claimed is:

1. A directional coupler comprising:

an element body that is insulating; and a main line and a secondary line both disposed in the element body and being conductive, wherein the directional coupler has a mount surface positioned on a mounted side when the directional coupler is mounted;

a first line portion of the main line and a second line portion of the secondary line are electromagnetically coupled to each other; and the first line portion has a thickness smaller than a line width of the first line portion, and is disposed in the element body in such a manner that an axis along a thickness direction of the first line portion does not intersect the mount surface, wherein the mount surface has a pair of first mounting terminals connected to respective ends of the main line, and a pair of second mounting terminals connected to respective ends of the secondary line, and wherein the pair of first mounting terminals and the pair of second mounting terminals are disposed on the mount surface and embedded from the mount surface into the element body.

2. The directional coupler according to claim 1, wherein the second line portion has a thickness smaller than a line width of the second line portion, and is disposed in the element body in such a manner that an axis along a thickness direction of the second line portion does not intersect the mount surface.

3. The directional coupler according to claim 2, wherein the axis along the thickness direction of the first line portion and the axis along the thickness direction of the second line portion are parallel to the mount surface.

4. The directional coupler according to claim 3, wherein the element body includes a plurality of insulating layers stacked along the thickness direction of the first line portion; and the first line portion and the second line portion are each disposed on one of the plurality of insulating layers.

5. The directional coupler according to claim 4, wherein the first line portion and the second line portion are arranged adjacent to each other in the thickness direction, with at least one of the plurality of insulating layers interposed therebetween.

6. The directional coupler according to claim 4, wherein the first line portion and the second line portion are disposed on the same surface of one of the plurality of insulating layers.

7. The directional coupler according to claim 2, wherein the first line portion has a surface perpendicular to the thickness direction of the first line portion, and is disposed in the element body in such a manner that the surface of the first line portion is perpendicular to the mount surface; and the second line portion has a surface perpendicular to the thickness direction of the second line portion, and is disposed in the element body in such a manner that the surface of the second line portion is perpendicular to the mount surface.

8. The directional coupler according to claim 4, further comprising a ground electrode disposed in the element body or on a surface of the element body, wherein the ground electrode is disposed on the insulating layer different from the insulating layer having the first line portion or second line portion disposed thereon.

9. The directional coupler according to claim 8, wherein the ground electrode is disposed outside a region between the first line portion and the second line portion in the thickness directions of the first line portion and the second line portion, the ground electrode being disposed in such a manner that an electrode surface of the ground electrode intersects the axes along the thickness directions of the first line portion and the second line portion.

10. The directional coupler according to claim 9, wherein the ground electrode is disposed in such a manner that the electrode surface is perpendicular to the mount surface.

11. A radio-frequency module comprising:

the directional coupler according to claim 1; and a mount substrate having the directional coupler mounted thereon, wherein the mount substrate includes a substrate electrode disposed parallel to a principal surface of the mount substrate; and the directional coupler is mounted on the mount substrate in such a manner that the mount surface is parallel to the substrate electrode.

12. The directional coupler according to claim 3, wherein the first line portion has a surface perpendicular to the thickness direction of the first line portion, and is disposed in the element body in such a manner that the surface of the first line portion is perpendicular to the mount surface; and the second line portion has a surface perpendicular to the thickness direction of the second line portion, and is disposed in the element body in such a manner that the surface of the second line portion is perpendicular to the mount surface.

13. The directional coupler according to claim 4, wherein the first line portion has a surface perpendicular to the thickness direction of the first line portion, and is disposed in the element body in such a manner that the surface of the first line portion is perpendicular to the mount surface; and the second line portion has a surface perpendicular to the thickness direction of the second line portion, and is disposed in the element body in such a manner that the surface of the second line portion is perpendicular to the mount surface.

14. The directional coupler according to claim 5, wherein the first line portion has a surface perpendicular to the thickness direction of the first line portion, and is disposed in the element body in such a manner that the surface of the first line portion is perpendicular to the mount surface; and the second line portion has a surface perpendicular to the thickness direction of the second line portion, and is disposed in the element body in such a manner that the surface of the second line portion is perpendicular to the mount surface.

15. The directional coupler according to claim 6, wherein the first line portion has a surface perpendicular to the thickness direction of the first line portion, and is disposed in the element body in such a manner that the surface of the first line portion is perpendicular to the mount surface; and the second line portion has a surface perpendicular to the thickness direction of the second line portion, and is disposed in the element body in such a manner that the surface of the second line portion is perpendicular to the mount surface.

* * * * *